US007746317B2

(12) United States Patent
Fu et al.

(10) Patent No.: US 7,746,317 B2
(45) Date of Patent: Jun. 29, 2010

(54) LIQUID CRYSTAL DISPLAY HAVING A LIGHT SENSOR AND DRIVING METHOD THEREOF FOR ADJUSTING LUMINANCE ACCORDING TO THAT OF AMBIENT LIGHT

(75) Inventors: Zhan-Wei Fu, Shenzhen (CN); Ming-Hung Tsai, Miao-Li (TW)

(73) Assignees: Innocom Technology (Shenzhen) Co., Ltd., Shenzhen, Guangdong Province (CN); Innolux Display Corp., Miao-Li County (TW)

( * ) Notice: Subject to any disclaimer, the term of this patent is extended or adjusted under 35 U.S.C. 154(b) by 579 days.

(21) Appl. No.: 11/645,412

(22) Filed: Dec. 26, 2006

(65) Prior Publication Data

US 2007/0146301 A1 Jun. 28, 2007

(30) Foreign Application Priority Data

Dec. 23, 2005 (TW) ..... 94146323 A

(51) Int. Cl.
*G09G 3/36* (2006.01)

(52) U.S. Cl. ..... 345/102; 345/87

(58) Field of Classification Search ..... 345/87–102, 345/204

See application file for complete search history.

(56) References Cited

U.S. PATENT DOCUMENTS

| | | | | |
|---|---|---|---|---|
| 6,078,302 | A * | 6/2000 | Suzuki | 345/77 |
| 6,518,561 | B1 | 2/2003 | Miura | |
| 7,057,593 | B2 * | 6/2006 | Cho | 345/87 |
| 7,564,438 | B2 * | 7/2009 | Kao et al. | 345/89 |
| 2005/0058450 | A1 | 3/2005 | Yamamoto et al. | |
| 2005/0087671 | A1 * | 4/2005 | Park | 250/205 |
| 2005/0116910 | A1 | 6/2005 | Lee et al. | |
| 2005/0168428 | A1 * | 8/2005 | Nakajima et al. | 345/99 |
| 2005/0231457 | A1 * | 10/2005 | Yamamoto et al. | 345/102 |
| 2006/0055690 | A1 * | 3/2006 | Hashidume et al. | 345/207 |
| 2007/0075951 | A1 * | 4/2007 | Lin et al. | 345/89 |
| 2007/0091055 | A1 * | 4/2007 | Sakuda | 345/102 |
| 2007/0132706 | A1 * | 6/2007 | Nishimura et al. | 345/102 |
| 2007/0159410 | A1 * | 7/2007 | Yamamoto et al. | 345/1.1 |
| 2008/0043027 | A1 * | 2/2008 | Shiomi et al. | 345/501 |

FOREIGN PATENT DOCUMENTS

| | | | |
|---|---|---|---|
| CN | 1399458 | A | 2/2003 |
| CN | 1595254 | A | 3/2005 |
| JP | 2005-70065 | A | 3/2005 |
| TW | 511069 | B | 11/2002 |
| TW | 275502 | Y | 11/2005 |

* cited by examiner

*Primary Examiner*—Nitin Patel
(74) *Attorney, Agent, or Firm*—Wei Te Chung

(57) ABSTRACT

An exemplary liquid crystal display (200) has a liquid crystal panel (240); a gate driving circuit (230) configured for scanning the liquid crystal panel; a data driving circuit (220) configured for providing a plurality of gradation voltages to the liquid crystal panel; a photo sensor (241) configured for measuring a luminance of ambient light and generating a corresponding optical signal; a luminance control circuit (231) for receiving the optical signal from the photo sensor and transferring the optical signal to a measurement signal; a timing control circuit (210) configured for controlling the gate driving circuit and the data driving circuit; and a backlight circuit (270) for driving a light source to emit light beams for illuminating the liquid crystal panel, according to the measurement signal from the luminance control circuit.

11 Claims, 3 Drawing Sheets

LIQUID CRYSTAL DISPLAY HAVING A LIGHT SENSOR AND DRIVING METHOD THEREOF FOR ADJUSTING LUMINANCE ACCORDING TO THAT OF AMBIENT LIGHT

FIELD OF THE INVENTION

The present invention relates to a liquid crystal display (LCD) and a driving method of the LCD for adjusting a luminance of a display screen of the active matrix LCD according to the refresh rate and the frequency of the ambient light.

GENERAL BACKGROUND

An active matrix LCD device has the advantages of portability, low power consumption, and low radiation, and has been widely used in various portable information products such as notebooks, personal digital assistants (PDAs), video cameras and the like. Furthermore, the active matrix LCD device is considered by many to have the potential to completely replace CRT (cathode ray tube) monitors and televisions.

FIG. 4 is an abbreviated block diagram of certain parts of a typical active matrix LCD. The LCD 100 includes a liquid crystal (LC) panel 140, a gate driving circuit 130, a data driving circuit 120, and a timing control circuit 110, a power supply 150, and a backlight circuit 170. The backlight circuit 170 drives a light source to emit light beams for illuminating the LC panel 140. The timing control circuit 110 is used to control the gate driving circuit 130 and the data driving circuit 120. The gate driving circuit 130 provides a plurality of scanning signals to the LC panel 140. The data driving circuit 120 provides a plurality of gradation voltages to the LC panel 140 when the LC panel 140 is scanned.

However, the LCD 100 can not automatically adjust the brightness when the ambient brightness is changed. Thus a user may find that his or her eyes easily become tired.

What is needed, therefore, is an LCD that can overcome the above-described deficiency.

SUMMARY

In one preferred embodiment, a liquid crystal display has a liquid crystal panel; a gate driving circuit configured for scanning the liquid crystal panel; a data driving circuit configured for providing a plurality of gradation voltages to the liquid crystal panel; a photo sensor configured for measuring a luminance of ambient light and generating a corresponding optical signal; a luminance control circuit for receiving the optical signal from the photo sensor and transferring the optical signal to a measurement signal; a timing control circuit configured for controlling the gate driving circuit and the data driving circuit; and a backlight circuit for driving a light source to emit light beams for illuminating the liquid crystal panel, according to the measurement signal from the luminance control circuit.

A driving method of the liquid crystal display includes the steps of: a) detecting a luminance of ambient light by the photo sensor, generating a corresponding optical signal representing the luminance of the ambient light, and transmitting the optical signal to the luminance control circuit; b) judging the luminance of the ambient light by the luminance control circuit and sending a measurement signal to the backlight circuit; c) adjusting the luminance of a light source according to the measurement signal via control by the backlight circuit; and d) feedbacking the actual luminance of the light source to the luminance control circuit.

Other advantages and novel features will become more apparent from the following detailed description when taken in conjunction with the accompanying drawings.

DETAILED DESCRIPTION OF PREFERRED EMBODIMENTS

Figure 1:
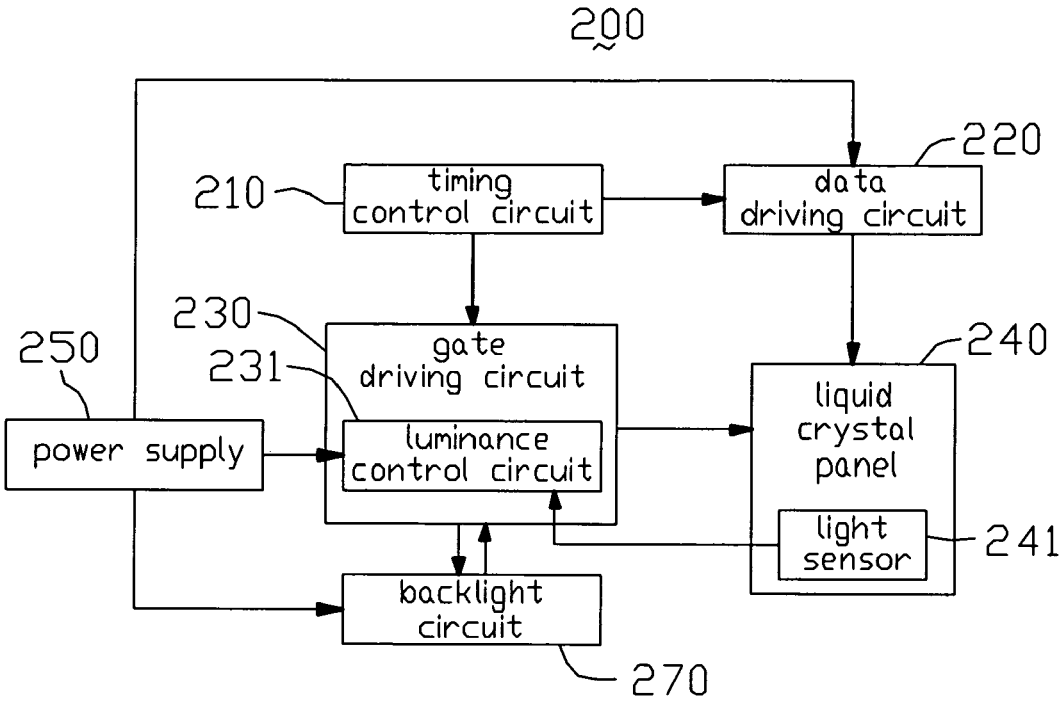
FIG. 1 is an abbreviated block diagram of certain parts of an active matrix LCD according to a first embodiment of the present invention, the LCD including a timing control circuit.
Figure 2:
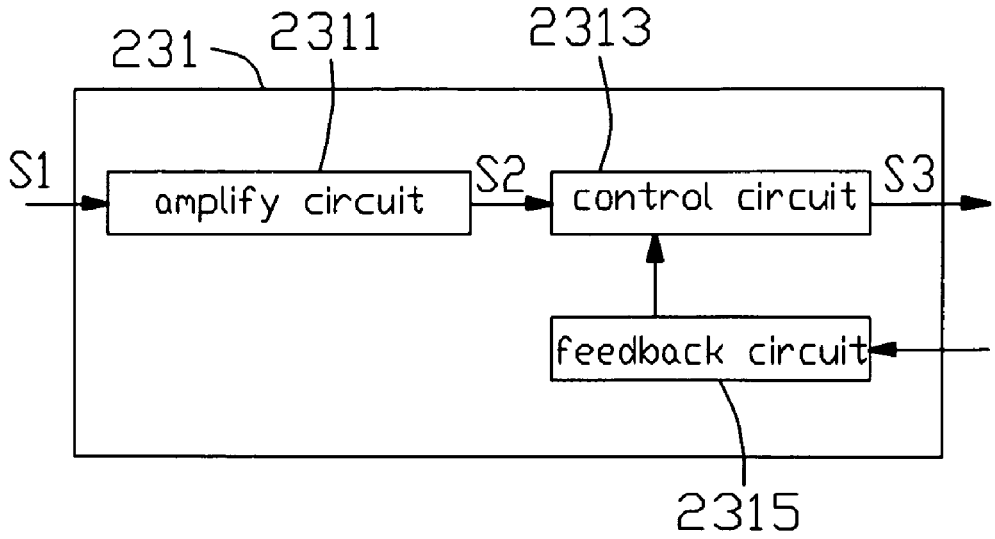
FIG. 2 is an abbreviated block diagram of a brightness controlling circuit of the active matrix LCD of FIG. 1.

FIG. 1 is an abbreviated block diagram of certain parts of an active matrix LCD according to a first embodiment of the present invention. The active matrix LCD 200 includes a liquid crystal (LC) panel 240. The active matrix LCD 200 is configured such that an image shown on a display screen (not shown) of the LC panel 240 is refreshed. The active matrix LCD 200 also includes a timing control circuit 210, a power supply 250, a gate driving circuit 230 connecting with the timing control circuit 210 and the power supply 250, a data driving circuit 220 connecting with the timing control circuit 210 and the power supply 250, a luminance controlling circuit 231 integrated in the gate driving circuit 230, a photo sensor 241, and a backlight circuit 270. The photo sensor 241 is positioned on the LC panel 240 and is electrically coupled to the luminance controlling circuit 231. The luminance controlling circuit 231 controls the backlight circuit 270 and drives a light source (not shown) to emit light beams for illuminating the LC panel 240. The light source may be a light emitting diode (LED), or a cold cathode fluorescent lamp (CCFL).

The luminance controlling circuit 231 has an amplify circuit 2311, a control circuit 2313, and a feedback circuit 2315. The amplify circuit 2311 connects with the photo sensor 241, which is used to receive the ambient optical signal S1 from the photo sensor 241. After that, the amplify circuit 2311 transfers the ambient optical signal S1 to an amplified electrical signal S2, and sends the amplified electrical signal S2 to the control circuit 2313. When the control circuit 2313 receives the amplified electrical signal S2, it transfers the amplified electrical signal S2 to a control signal S3 and sends the signal to backlight circuit 270. The backlight circuit 270 adjusts the luminance of the light source and sends the adjust result to the control circuit 2313 through the feedback circuit 2315 to attain a stable luminance.

The timing control circuit 210 controls the gate driving circuit 230 and the data driving circuit 220. The gate driving circuit 230 provides a plurality of scanning signals to the LC panel 240. The data driving circuit 220 provides a plurality of gradation voltages to the LC panel 240 when the LC panel 240 is scanned. The photo sensor 241 is configured for measuring a luminance of ambient light, and providing a measurement signal representing the luminance of the ambient light to the luminance controlling circuit 231. Thus luminance controlling circuit 231 controls the backlight circuit 270 to adjust the luminance of the light source according to the measurement signal. For example, when the luminance of the ambient light is low, the luminance of the light source can be decreased according to the ambient light so as to decrease the luminance of the display screen of the LC panel 240. This can help a user comfortably view the display screen.

Figure 3:
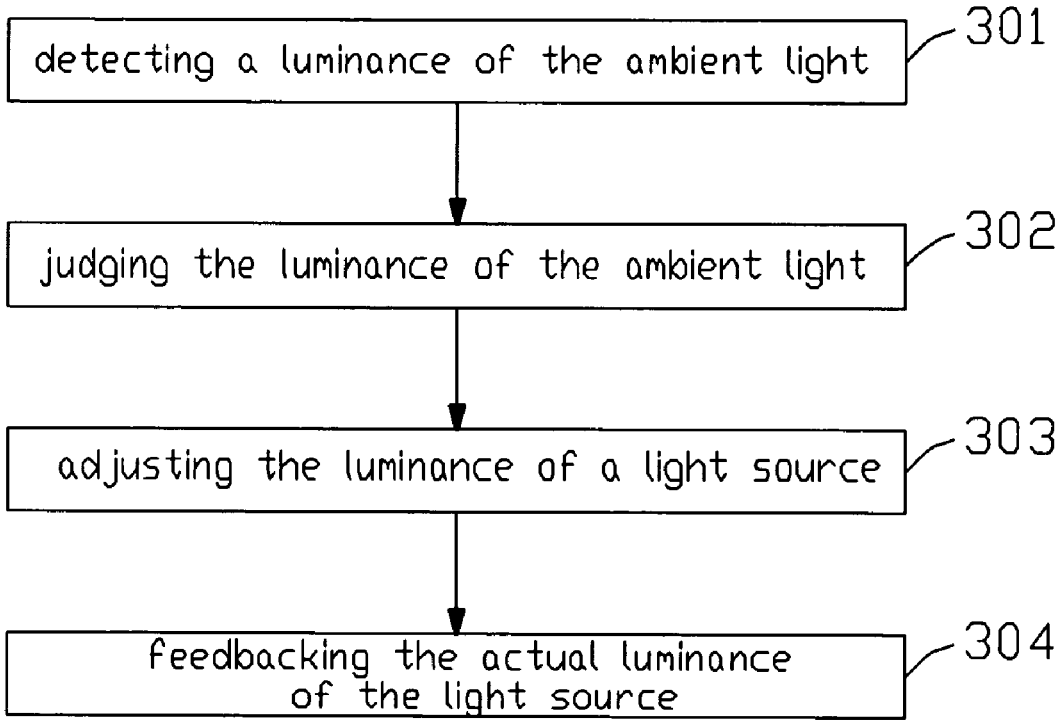
FIG. 3 is a flowchart of an exemplary driving method used to adjust a luminance of the LCD of FIG. 1.
Figure 4:
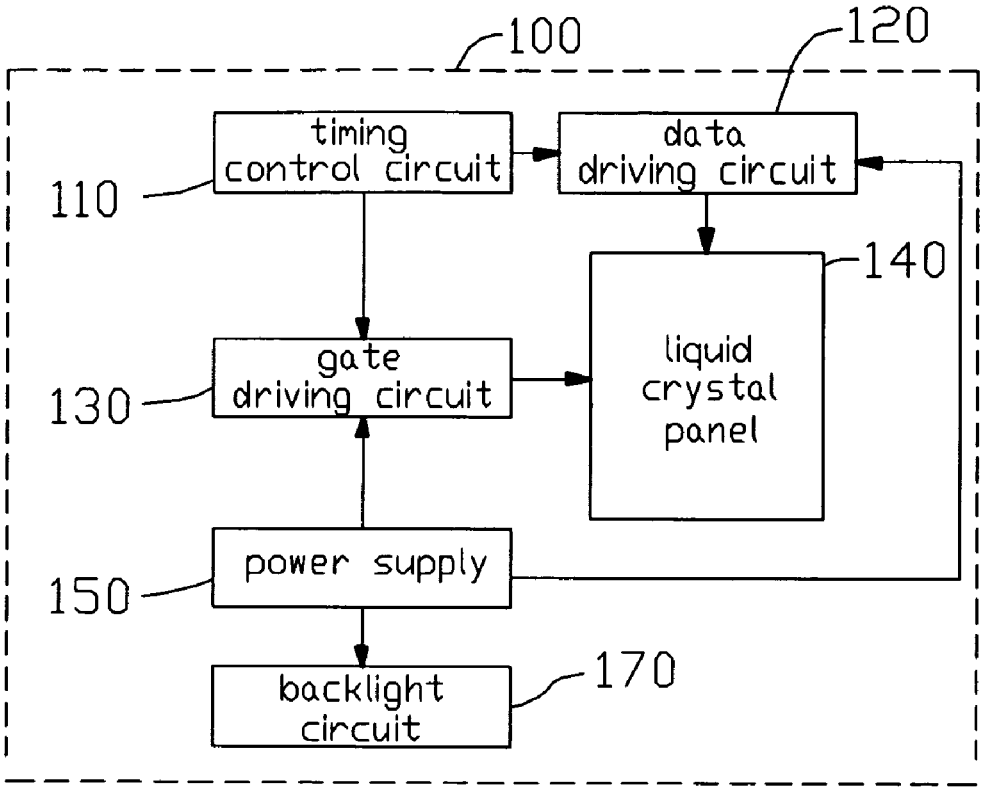
FIG. 4 (RELATED ART)
FIG. 4 is an abbreviated block diagram of certain parts of a conventional active matrix LCD.

Referring to FIG. 3, a driving method used to adjust a refresh rate and a luminance of the LCD 200 includes the following steps:

step 301: detecting a luminance of the ambient light by the photo sensor 241, and generating a measurement signal representing the luminance of the ambient light to the luminance controlling circuit 231, in the luminance controlling circuit 231, and amplifying the measurement signal in the luminance controlling circuit 231;

step 302: judging the luminance of the ambient light, when the amplify circuit 2311 of the luminance control circuit 231 receives the luminance signal of the ambient light from the photo sensor 241, the amplify circuit 2311 amplifying and transferring the signal to an electrical signal and sending the electrical signal to the control circuit 2313, after that, the control circuit 2313 judging the luminance of the ambient light according to the received electrical signal and sending a measurement signal to the backlight circuit 270;

step 303: adjusting the luminance of a light source according to the measurement signal via control by the backlight circuit 270.

step 304: feedbacking the actual luminance of the light source; the backlight circuit 270 sending back the adjusting result to the control circuit 2313 of the luminance driving circuit 231 through the feedback circuit 2315, after that the control circuit 2313 maintain a stable measurement signal according to the adjusting result of the backlight circuit 270.

Compared with the above-described conventional LCD 100, the LCD 200 use an photo sensor 241 to detect the luminance of the ambient light, and then adjusts the luminance of the light source via the luminance control circuit 231 and the backlight circuit 270. This can help a user comfortably view the display screen of the LC panel 240 when the luminance of the ambient light changes.

It is to be understood, however, that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid crystal display, comprising:

a liquid crystal panel;

a gate driving circuit configured for scanning the liquid crystal panel;

a data driving circuit configured for providing a plurality of gradation voltages to the liquid crystal panel;

a photo sensor configured for measuring a luminance of ambient light and generating a corresponding optical signal;

a luminance control circuit for receiving the optical signal from the photo sensor and transferring the optical signal to a measurement signal;

a timing control circuit configured for controlling the gate driving circuit and the data driving circuit; and a backlight circuit for driving a light source to emit light beams for illuminating the liquid crystal panel, according to the measurement signal from the luminance control circuit.

2. The liquid crystal display as claimed in claim 1, wherein the photo sensor is formed at the liquid crystal panel.

3. The liquid crystal display as claimed in claim 1, wherein the luminance control circuit is integrated in the gate driving circuit or the data driving circuit.

4. The liquid crystal display as claimed in claim 1, wherein the luminance control circuit comprises a amplify circuit for amplifying the optical signal and transferring the optical signal to an electrical signal and a control circuit receiving the electrical signal to produce a measurement signal.

5. The liquid crystal display as claimed in claim 4, wherein the luminance control circuit further comprises a feedback circuit for feedbacking the actual adjust result of the backlight circuit to the control circuit.

6. The liquid crystal display as claimed in claim 1, wherein the photo sensor is made from amorphous silicon material.

7. A driving method for a liquid crystal display, the liquid crystal display comprising a liquid crystal panel, an photo sensor positioned at the liquid crystal panel, a timing control circuit, a luminance control circuit, and a backlight circuit, the driving method comprising:

detecting a luminance of ambient light by the photo sensor, generating a corresponding optical signal representing the luminance of the ambient light, and transmitting the optical signal to the luminance control circuit;

judging the luminance of the ambient light by the luminance control circuit and sending a measurement signal to the backlight circuit;

adjusting the luminance of a light source according to the measurement signal via control by the backlight circuit; and feedbacking the actual luminance of the light source to the luminance control circuit.

8. The driving method as claimed in claim 7, wherein the luminance control circuit comprises a amplify circuit for amplifying the optical signal and transferring the optical signal to an electrical signal and a control circuit receiving the electrical signal to produce a measurement signal.

9. The driving method as claimed in claim 8, wherein the luminance control circuit further comprises a feedback circuit for feedbacking the actual adjust result of the backlight circuit to the control circuit.

10. The driving method as claimed in claim 9, wherein when the amplify circuit of the luminance control circuit receives the luminance signal of the ambient light from the photo sensor, the amplify circuit amplifies and transfers the signal to an electrical signal and sending the electrical signal to the control circuit, after that, the control circuit judges the luminance of the ambient light according to the received electrical signal and sends a measurement signal to the backlight circuit.

11. A liquid crystal display, comprising:

a liquid crystal panel;

a gate driving circuit driven by a power supply to actuate the liquid crystal panel;

a data driving circuit driven by said power supply to provide a plurality of gradation voltages to the liquid crystal panel;

a sensor configured measuring a light and generating a corresponding signal;

a luminance control circuit receiving the signal from the sensor;

a timing control circuit controlling the gate driving circuit and the data driving circuit; and a backlight circuit actuated by the power supply to drive a light source to emit light beams for illuminating the liquid crystal panel, according to the signal from the luminance control circuit.

* * * * *